US007154366B2

(12) United States Patent
Hsueh et al.

(10) Patent No.: US 7,154,366 B2
(45) Date of Patent: Dec. 26, 2006

(54) BOBBIN MODULE OF TRANSFORMER

(75) Inventors: Ching-Fu Hsueh, Bade (TW); Wen-Hsien Chen, Guansi Township, Hsinchu County (TW); Wan-Chin Hsu, Dasi Township, Taoyuan County (TW)

(73) Assignee: Darfon Electronics Corp., Taoyuan (TW)

( * ) Notice: Subject to any disclaimer, the term of this patent is extended or adjusted under 35 U.S.C. 154(b) by 0 days.

(21) Appl. No.: 11/365,180

(22) Filed: Mar. 1, 2006

(65) Prior Publication Data

US 2006/0197643 A1 Sep. 7, 2006

(30) Foreign Application Priority Data

Jun. 1, 2005 (TW) ..... 94106147 A

(51) Int. Cl.
*H01F 27/30* (2006.01)

(52) U.S. Cl. ..... 336/198

(58) Field of Classification Search ..... 336/65, 336/83, 90–96, 192, 198
See application file for complete search history.

(56) References Cited

U.S. PATENT DOCUMENTS

| | | | | |
|---|---|---|---|---|
| 3,605,055 | A * | 9/1971 | Grady | 336/185 |
| 3,675,174 | A * | 7/1972 | Horbach | 335/299 |
| 3,750,073 | A * | 7/1973 | Okano | 336/198 |
| 4,000,483 | A * | 12/1976 | Cook et al. | 336/198 |
| 6,630,880 | B1 * | 10/2003 | Cheung et al. | 336/198 |
| 6,727,793 | B1 * | 4/2004 | Piechnick | 336/198 |
| 6,906,609 | B1 * | 6/2005 | Piechnick | 336/198 |

* cited by examiner

*Primary Examiner*—Tuyen T. Nguyen
(74) *Attorney, Agent, or Firm*—Thomas, Kayden, Horstemeyer & Risley

(57) ABSTRACT

A bobbin module of transformer is provided. The bobbin module includes two bobbins. Each of the bobbins comprises a body, an indentation and a hooker. The body has a lateral surface on which the indentation and the hooker are disposed. The hooker and the indentation of the bobbin are respectively engaged with the hooker and the indentation of the other bobbin so that the two bobbins are combined together.

8 Claims, 8 Drawing Sheets

BOBBIN MODULE OF TRANSFORMER

This application claims the benefit of Taiwan application Ser. No. 94106147, filed Mar. 1, 2005, the subject matter of which is incorporated herein by reference.

BACKGROUND OF THE INVENTION

1. Field of the Invention

The invention relates in general to a bobbin of transformer, and more particularly to a bobbin module of transformer capable of decreasing mold cost and increasing pressure resistance.

2. Description of the Related Art

With the popularity of multi-media products, the application of liquid crystal display (LCD) such as computer monitor and LCD TV is also becoming more and more popular. Typically, the LCD adopts slim and high efficient lamp tube driving system as the backlight, so that the thickness is reduced and that the display quality is improved. The lamp tube driving system of an LCD mainly consists of a cold cathode fluorescent lamp (CCFL) discharge lamp tube and a transformer used for driving the CCFL. Under the current trend of large-scaled LCD, the number of the lamp tubes is increased and the scale of the lamp tube enlarged. Consequently, the lamp tube driving voltage is increased. For example, the lamp tube driving voltage is increased from 1 KV to 3 KV and above, and the number of turns of the primary coils and the secondary coils are increased accordingly.

Conventionally, two bobbins are combined to provide more turns of the primary coils and the secondary coils. If two bobbins are combined to form a bobbin module, the combination must include one male bobbin and one female bobbin, and the two dimensional positioning for assembly can only be achieved in the x direction and the y direction. However, if the design of coupling one male bobbin with one female bobbin is adopted, two different molds are required to manufacture the male bobbin and the female bobbin respectively. Thus, the mold cost will be increased. Besides, when the bobbin module is hit by an external force, the two bobbins of the bobbin module may separate in the z direction.

Furthermore, after a conventional bobbin is wound in the primary coil and the secondary coil, the bobbin will form a transformer with an iron core. Then, the transformer is enclosed by the tape. However, the process of enclosing the bobbin, the coil and the iron core with the tape is very time-consuming and difficult, and the material cost for the tape is significant. Since the conventional transformer whose bobbin, coil and iron core are enclosed by the tape has a poor performance in pressure resistance, the conventional transformer is difficult to meet the requirements of the current trend of enlarging the scale of LCD panel and increasing the voltage of the lamp tube driving voltage.

SUMMARY OF THE INVENTION

It is therefore an object of the invention to provide a bobbin module of transformer capable of decreasing mold cost and increasing pressure resistance. The invention forms two bobbins of identical structure by having the hooker and the indentation of a bobbin which are symmetric to each other be coupled together, not only making the assembly faster, but also achieving the positioning in x, y and z directions for assembly lest the separation of bobbin might occur when the conventional bobbin module receives an external force in the z direction. Besides, the invention requires only one set of mold. The manufacturer does not need to manufacture respective molds for the male bobbin mold and the female bobbin mold, largely decreasing the mold cost.

Furthermore, the invention achieves the object of fast positioning the bobbin and the base for assembly by using the design of engaging the fourth engaging blade of a bobbin with the first engaging blade of a base. The invention uses the second engaging blade and the third engaging blade to separate the two iron cores disposed in the first magnetic core receiving region and the second magnetic core receiving region from the coils of the primary coil and the secondary coil wound in the bobbin, substantially enhancing the pressure resistance of transformer and complying with the current trend in the design of enlarging the scale of the LCD panel and increasing the voltage of the lamp tube driving voltage.

The invention further achieves the above-identified object by providing a bobbin module of transformer. The bobbin module includes two bobbins. Each of the bobbins comprises a body, an indentation and a hooker. The body has a lateral surface. The indentation and the hooker are disposed on the lateral surface. The hooker and the indentation of a bobbin are respectively engaged with the hooker and the indentation of the other bobbin so that the two bobbins are combined together.

The invention further achieves the above-identified object by providing a bobbin module of transformer comprising a base and a bobbin. The base has a fillister. The bottom of the fillister has a first engaging blade, a second engaging blade and a third engaging blade parallel to the second engaging blade disposed thereon. The first engaging blade is perpendicular to and positioned between the second engaging blade and the third engaging blade. There is a first magnetic core receiving region existing between the second engaging blade and one wall of the fillister. There is a second magnetic core receiving region existing between the third engaging blade and the other wall of the fillister. The bobbin has a fourth engaging blade. Part of the fourth engaging blade is engaged with the first engaging blade, and part of the edge of the fourth engaging blade is abutted against the second engaging blade and the third engaging blade, so that the bobbin is fixed in the fillister in two mutually perpendicular directions.

Other objects, features, and advantages of the invention will become apparent from the following detailed description of the preferred but non-limiting embodiments. The following description is made with reference to the accompanying drawings.

DETAILED DESCRIPTION OF THE INVENTION

First Embodiment

Figure 1A:
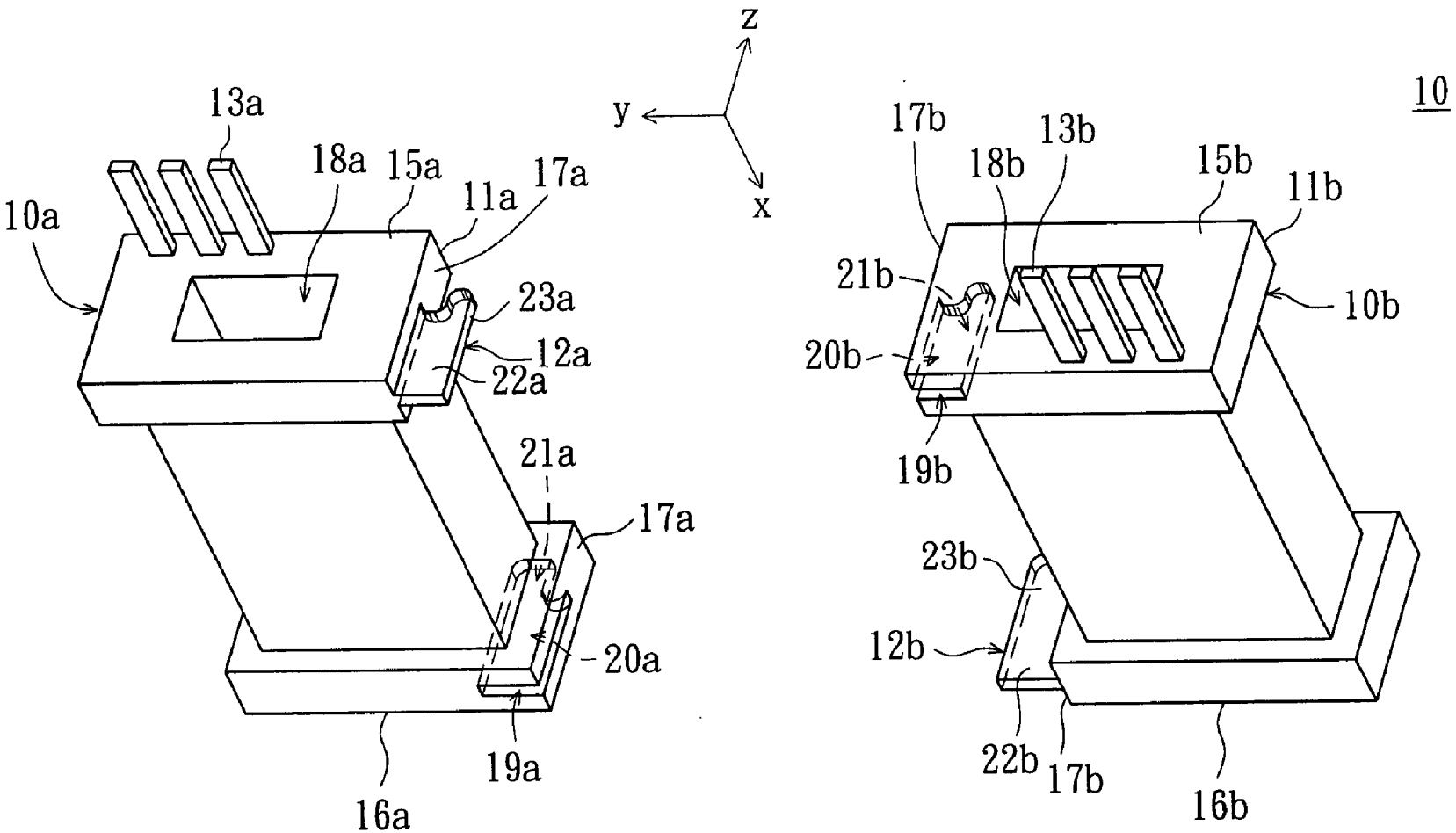
FIG. 1A is an exploded diagram of a bobbin module of transformer according to a first embodiment of the invention.
Figure 1B:
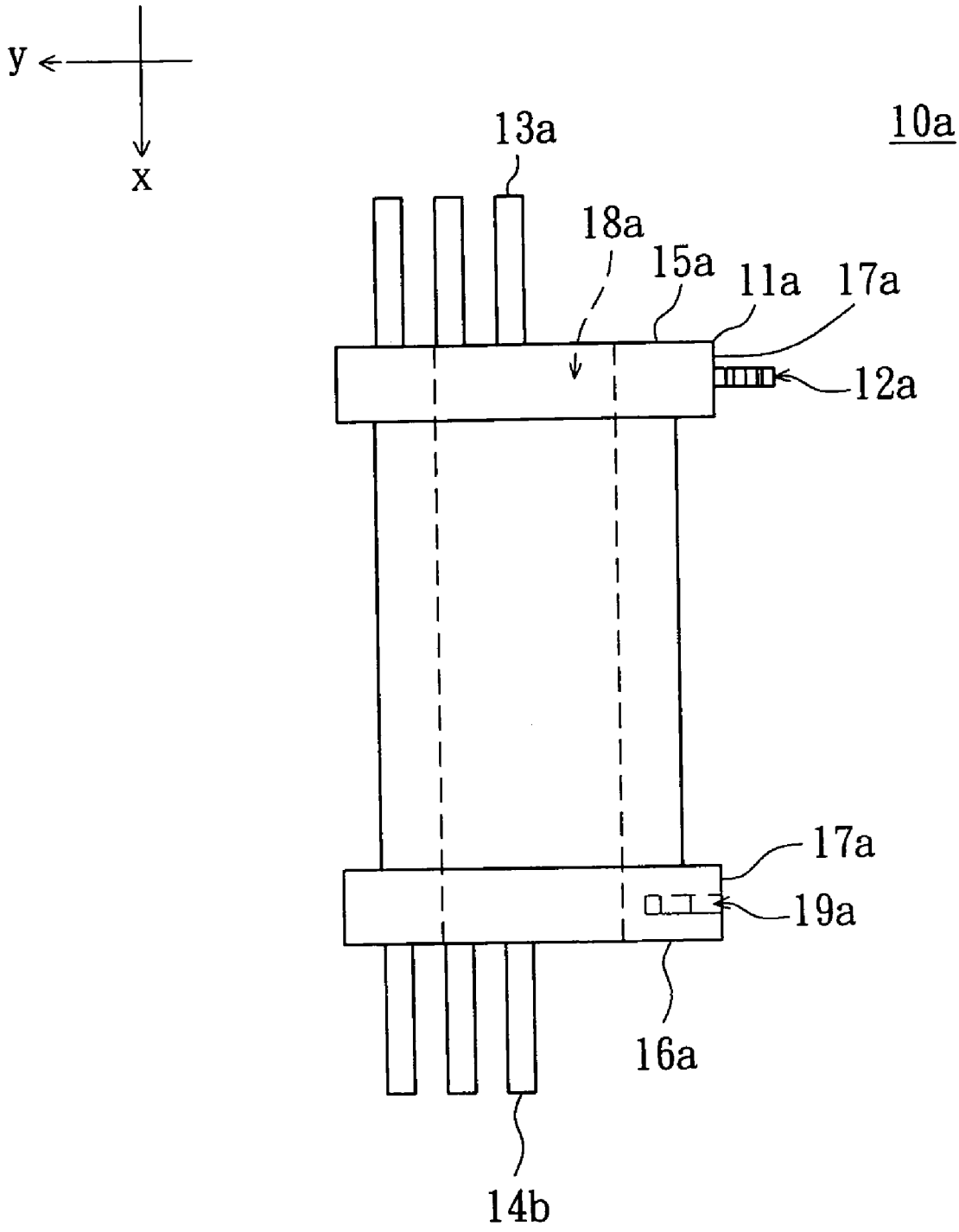
FIG. 1B is top view of a bobbin of FIG. 1A.

Referring to FIG. 1A, an exploded diagram of a bobbin module of transformer according to a first embodiment of the invention is illustrated. In FIG. 1A, the bobbin module of transformer 10 comprises two bobbins 10*a* and 10*b*. The bobbins 10*a* and 10*b* have the same structure and can be formed using the same bobbin mold. Thus, there is no need to manufacture respective molds for the male bobbin and the female bobbin, largely decreasing the mold cost. As shown in FIG. 1B, the bobbin 10*a* comprises a body 11*a*, a hooker 12*a* and an indentation 19*a*. The body 11*a* has a lateral surface 17*a* on which the hooker 12*a* and the indentation 19*a* are disposed. Similarly, the bobbin 10*b* comprises a body 11*b*, a hooker 12*b* and an indentation 19*b*. The body 11*b* has a lateral surface 17*b* on which the hooker 12*b* and the indentation 19*b* are disposed. When the bobbins 10*a* and 10*b* are combined together, the hooker 12*a* and the indentation 19*a* of the bobbin 10*a* are respectively engaged with the indentation 19*b* and the hooker 12*b* of the other bobbin 10*b*, so that the bobbin 10*a* and the bobbin 10*b* are combined together to form the bobbin module 10 by correspondingly coupling the hookers 12*a* and 12*b* with the indentations 19*b* and 19*a*.

Besides, the bobbin 10*a* further comprises at least a first pin 13*a* and at least a second pin 14*a*. The body 11*a* is wound by the primary coil and the secondary coil. The body 11*a* has a first surface 15*a*, a second surface 16*a* opposite to the first surface 15*a*, and a through hole 18*a*. The through hole 18*a*, which penetrates through the first surface 15*a* and the second surface 16*a*, is for a magnetic core to pass through. Examples of the magnetic core include an iron core. The lateral surface 17*a* connects with the first surface 15*a* and the second surface 16*a*. The indentation 19*a* is adjacent to the second surface 16*a*. The hooker 12*a* is adjacent to the first surface 15*a*. In the present embodiment of the invention, the indentation 19*a* has a gap 20*a* and a recess 21*a* accessible to each other. The hooker 12*a* comprises an elbow 22*a* and a protrusion 23*a*. One end of the elbow 22*a* is connected to the lateral surface 17*a*. The protrusion 23*a* is disposed on the other end of the elbow 22*a*, and is slightly protruded towards the lateral surface 17*a*. The first pin 13*a* and the second pin 14*a* are respectively disposed on the first surface 15*a* and the second surface 16*a* for enabling the primary coil and the secondary coil to be electrically connected to an external circuit. The body 11*a* and the hooker 12*a* can be integrally formed in one piece.

Figure 1C:
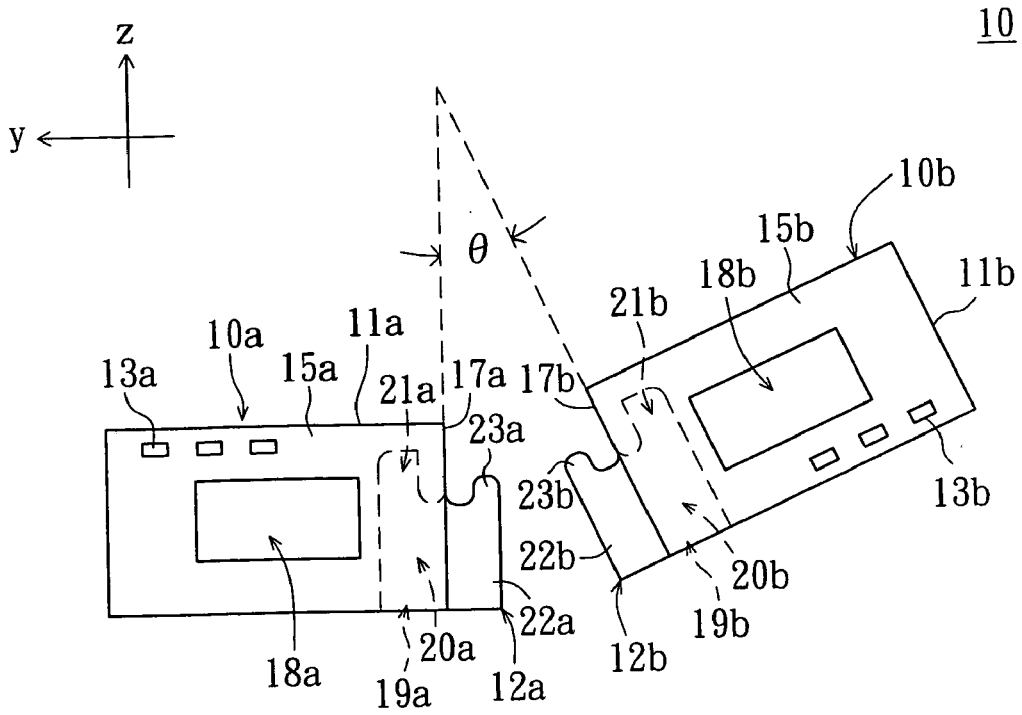
FIG. 1C is a top view illustrating the state when the lateral surfaces of two bobbins of FIG. 1A viewed along the x direction form a contained angle.

Similarly, since the bobbin 10*b* has the same structure with the bobbin 10*a*, as shown in FIG. 1A, the bobbin 10*b* further comprises a first pin 13*b* and at least a second pin. The body 11*b* is wound by the primary coil and the secondary coil. The body 11*b* further has a first surface 15*b*, a second surface 16*b* opposite to the first surface 15*b*, and a through hole 18*b*. The through hole 18*b*, which penetrates through the first surface 15*b* and the second surface 16*b*, is for a magnetic core to pass through. Examples of the magnetic core include an iron core. The lateral surface 17*b* connects with the first surface 15*b* and the second surface 16*b*. The indentation 19*b* is adjacent to the second surface 16*b*. The hooker 12*b* is adjacent to the first surface 15*b*. The body 11*b* and the hooker 12*b* can be integrally formed in one piece. In the present embodiment of the invention, the indentation 19*b* has a gap 20*b* and a recess 21*b* accessible to each other. The hooker 12*b* comprises an elbow 22*b* and a protrusion 23*b*. One end of the elbow 22*b* is connected to the lateral surface 17*b*. The protrusion 23*b* is disposed on the other end of the elbow 22*b*, and is slightly protruded towards the lateral surface 17*b*. The first pin 13*b* and the second pin are respectively disposed on the first surface 15*b* and the second surface 16*b* for enabling the primary coil and the secondary coil to be electrically connected to an external circuit. As shown in FIG. 1C, when the user is to combine the bobbin 10*a* and the bobbin 10*b* together, firstly, the user correspondingly inserts the hookers 12*a* and 12*b* into part of the indentations 19*a* and 19*b* by forming a contained angle θ between the lateral surfaces 17*a* and 17*b*. That is to say, the user correspondingly inserts part of the elbow 22*a* and the protrusion 23*a* into the gap 20*b* and part of the recess 21*b*, and correspondingly inserts part of the elbow 22*b* and the protrusion 23*b* into the gap 20*a* and part of the recess 21*a*.

Figure 1D:
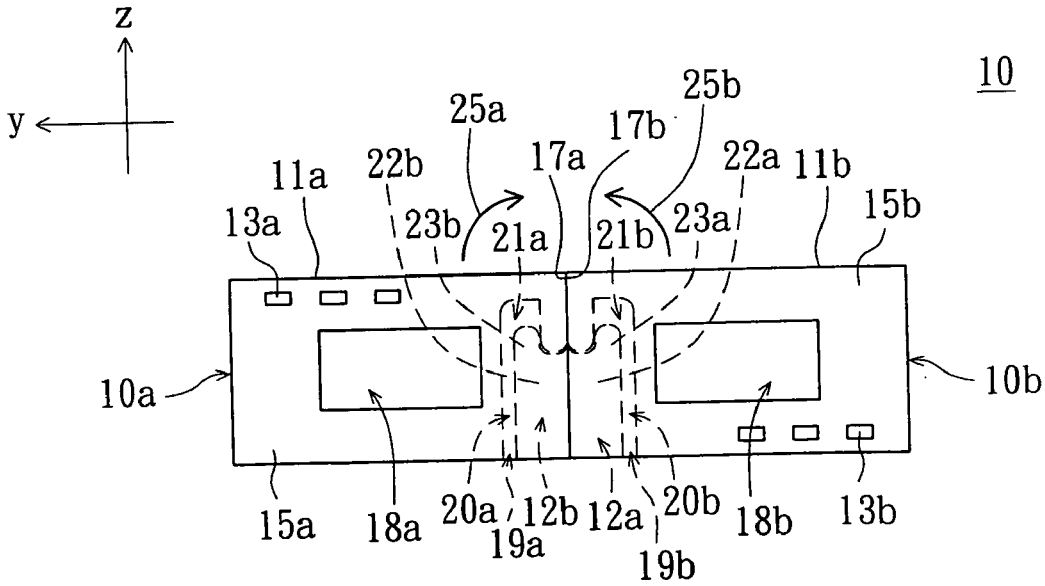
FIG. 1D illustrates the assembly of two bobbin modules of FIG. 1C.

Meanwhile, the bobbins 10*a* and 10*b* are at a preparatory assembly state. The contained angle θ ranges between 35~45 degrees. Next, the user rotates the bobbins 10*a* and 10*b* which are at the preparatory assembly state to achieve a state that the lateral surface 17*a* and the lateral surface 17*b* are parallel to and face each other, so that the hookers 12*a* and 12*b* are correspondingly engaged with the indentations 19*a* and 19*b* as shown in FIG. 1D. The protrusions 23*a* and 23*b* are correspondingly coupled with the gaps 21*b* and 21*a*, and the elbows 22*a* and 22*b* are correspondingly inserted into the gaps 20*b* and 20*a*. In the present embodiment of the invention, the design of engaging the hookers 12*a* and 12*b* with the indentations 19*a* and 19*b* ascertains that the bobbin module 10 is positioned in x, y and z directions for assembly and avoids the separation of the bobbin in the z direction which may occur when the conventional bobbin module receives an external force.

When the user is to separate the bobbins 10*a* and 10*b* of FIG. 1D, firstly, the user rotates the bobbins 10*a* and 10*b* along the direction of the arrows 25*a* and 25*b* to form a contained angle θ between the lateral surface 17*a* and the lateral surface 17*b*, so that the hookers 12*a* and 12*b* are separated from the indentations 19*a* and 19*b*. Next, the user can easily separate the bobbin 10*a* from the bobbin 10*b*, hence achieving the object of making assembly and disassembly easy and fast.

The present embodiment of the invention forms two bobbins of identical structure by having the hooker and the indentation of a bobbin which are symmetric to each other be coupled together, not only making the assembly faster, but also achieving the positioning in x, y and z directions for assembly lest the separation of bobbin might occur when the conventional bobbin module receives an external force in the z direction. Besides, the invention only requires one set of mold. The manufacturer does not need to manufacture respective molds for the male bobbin and the female bobbin, largely decreasing the mold cost.

Second Embodiment

Figure 2A:
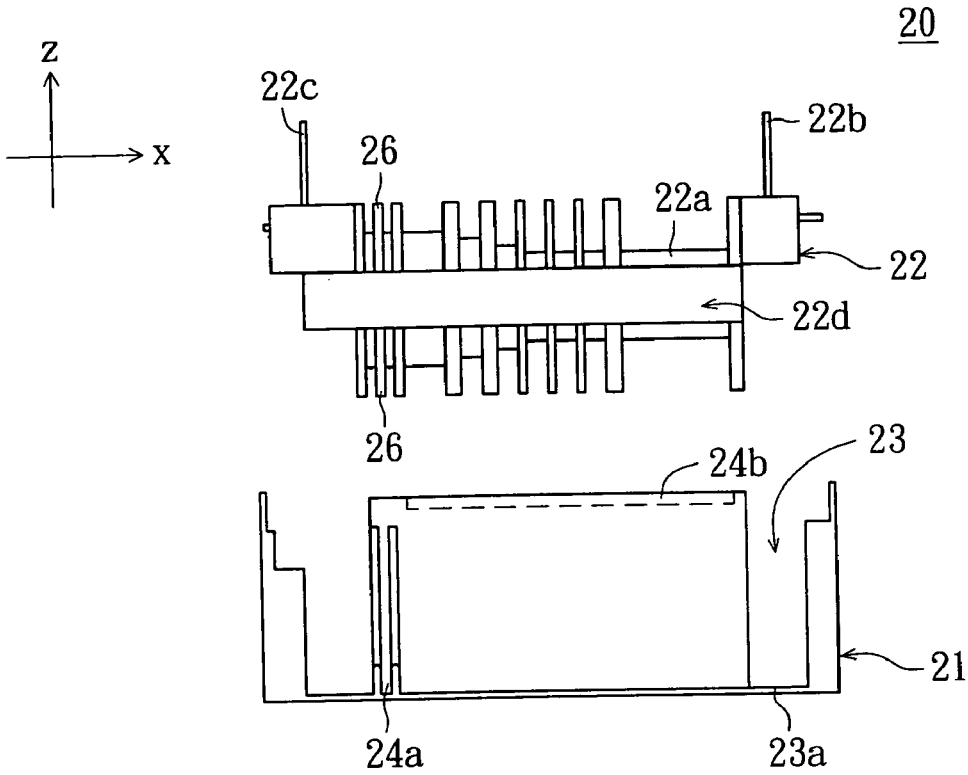
FIG. 2A is an exploded top view of a bobbin module of transformer according to a second embodiment of the invention.
Figure 2B:
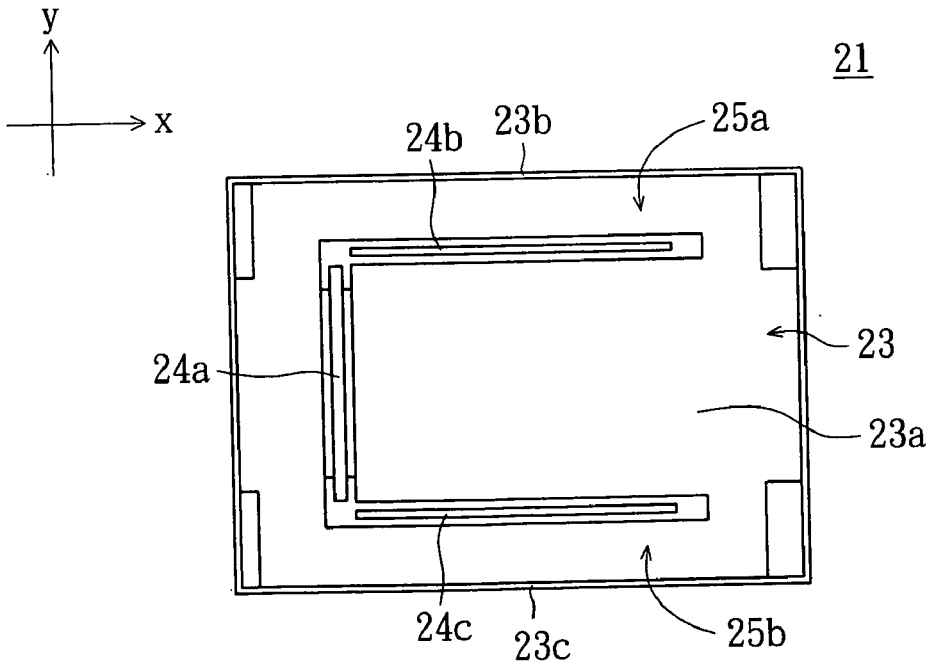
FIG. 2B is top view of a base of FIG. 2A.
Figure 2C:
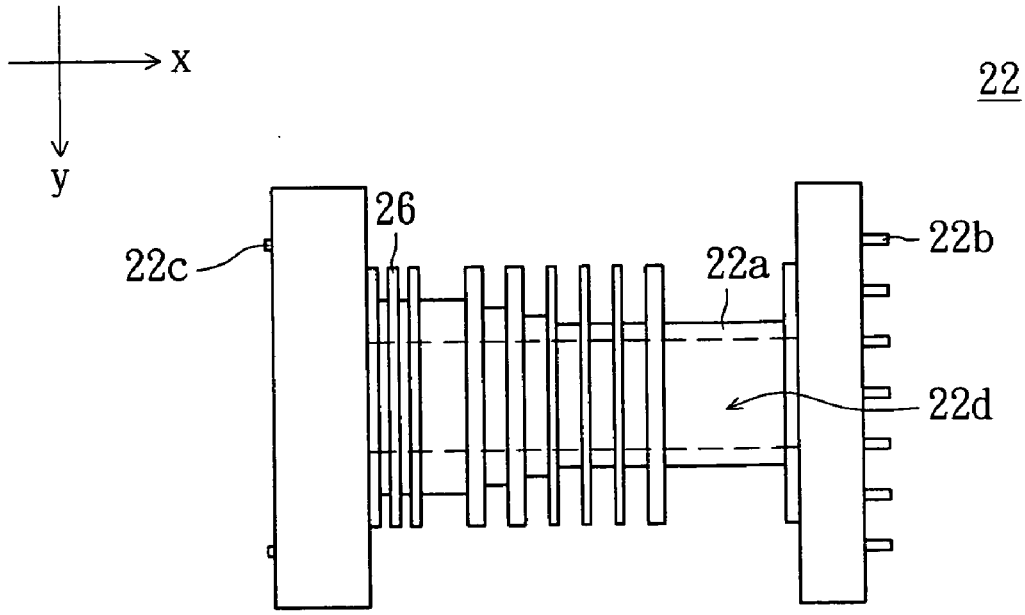
FIG. 2C is an upward view of the bobbin of FIG. 2A.
Figure 2D:
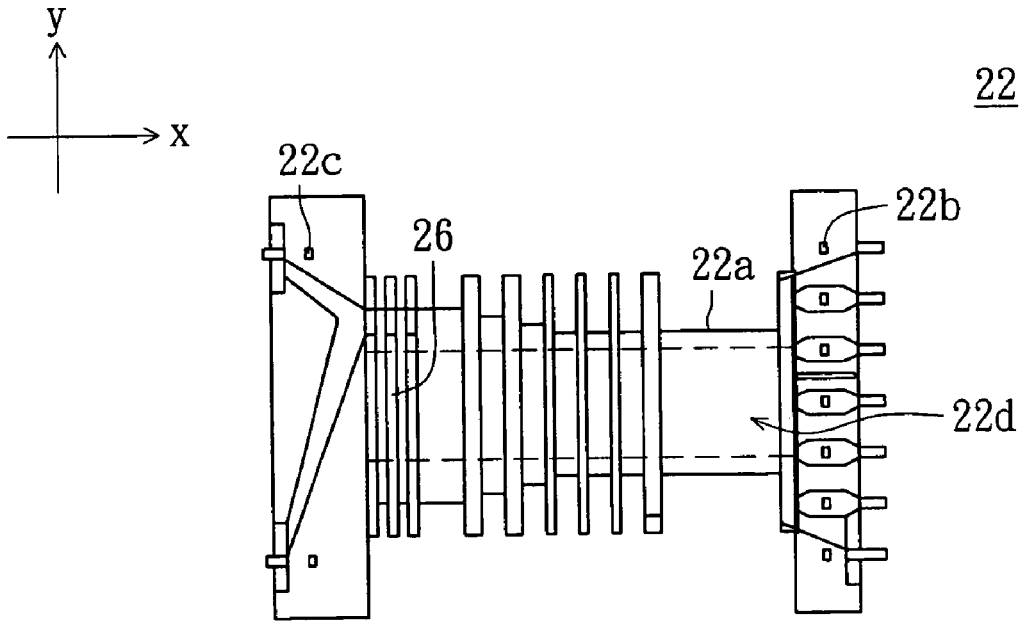
FIG. 2D is a top view of the bobbin of FIG. 2A.
Figure 2E:
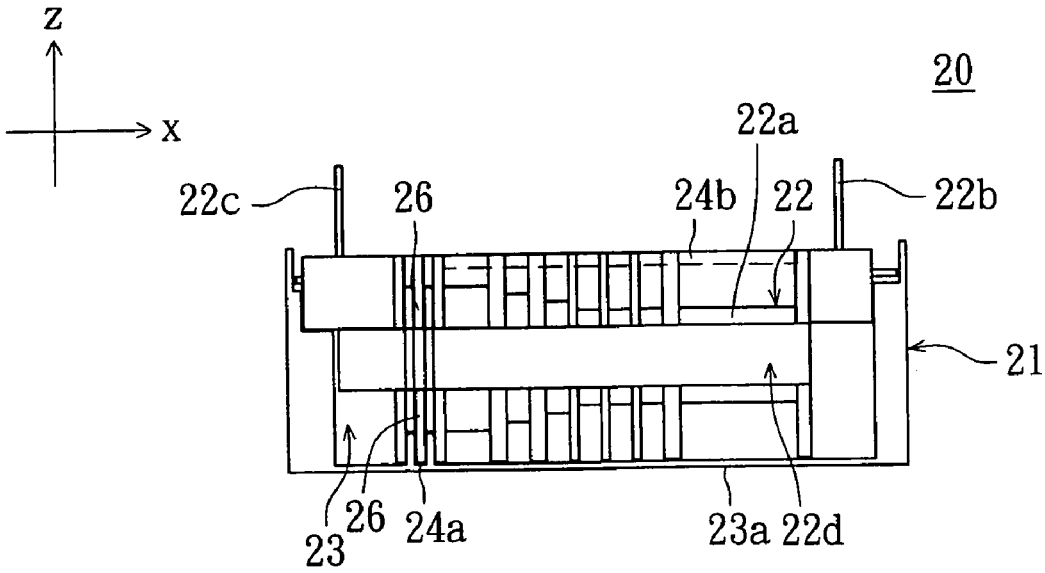
FIG. 2E is a cross-sectional diagram of assembly of the bobbin module of transformer according to the second embodiment of the invention.
Figure 2F:
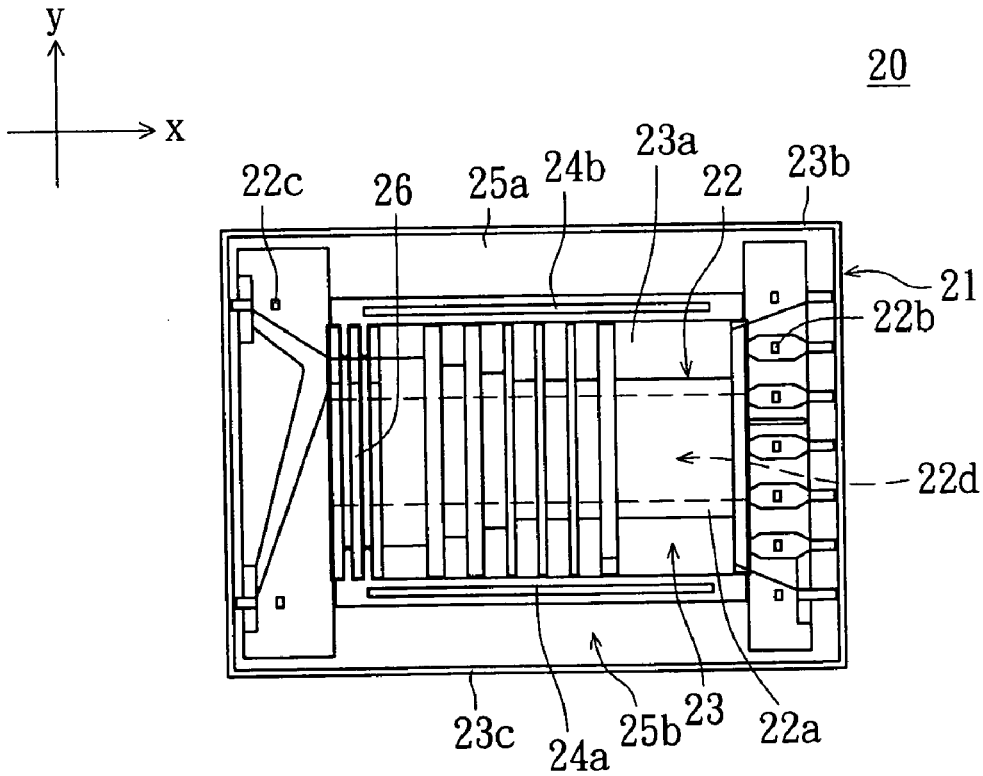
FIG. 2F is a top view of assembly of the bobbin module of transformer according to the second embodiment of the invention.

Please refer to FIGS. 2A~2F at the same time. FIG. 2A is an exploded top view of a bobbin module of transformer according to a second embodiment of the invention. FIG. 2B is top view of a base of FIG. 2A. FIG. 2C is an upward view of the bobbin of FIG. 2A. FIG. 2D is a top view of the bobbin of FIG. 2A. FIG. 2E is a cross-sectional diagram of assembly of the bobbin module of transformer according to the second embodiment of the invention. FIG. 2F is a top view of assembly of the bobbin module of transformer according to the second embodiment of the invention. In FIG. 2A, the bobbin module of transformer 20 comprises a base 21 and a bobbin 22. The bobbin 22 is engaged with the base 21 to be disposed on the base 21 As shown in FIG. 2B, the base 21 has a fillister 23 whose bottom 23*a* has a first engaging blade 24*a*, a second engaging blade 24*b* parallel to the first engaging blade 24*a*, and a third engaging blade 24*c* disposed thereon. The first engaging blade 24*a* is perpendicular to and positioned between the second engaging blade 24*b* and the third engaging blade 24*c*. Besides, the first engaging blade 24*a* can connect with the second engaging blade 24*b* and the third engaging blade 24*c*. The height of the first engaging blade 24*a* can be lower than the height of the second engaging blade 24*b* and the height of the third engaging blade 24*c*. Furthermore, there is a first magnetic core receiving region 25*a* existing between the second engaging blade 24*b* and one wall of 23*b* of the fillister 23. There is a second magnetic core receiving region 25*b* existing between the third engaging blade 24*c* and the other wall of 23*c* of the fillister 23. The first magnetic core receiving region 25*a* and the second magnetic core receiving region 25*b* are respectively used for receiving a first magnetic core and a second magnetic core such as a first iron core or a second iron core.

As shown in FIGS. 2C~2D, the bobbin 22 comprises a body 22*a*, a fourth engaging blade 26, a number of first pins 22*b* and a number of second pins 22*c*. The body 22*a* has a through hole 22*d* passing through the two ends of the body 22*a*. The through hole 22*d* is for the first iron core and the second iron core to plug into, so that the first iron core and the second iron core form a magnetic path in the bobbin module of transformer 10. The fourth engaging blade 26 winds itself round the body 22*a* to be disposed on the surface of the body 22*a*. Part of the fourth engaging blade 26 is engaged with the first engaging blade 24*a*. Part of the edge of the fourth engaging blade 26 is abutted against the second engaging blade 24*b* and the third engaging blade 24*c*. The other blades are wound on the surface of the body 22*a* for enabling the primary coil and the secondary coil to be wound round the body 22*a*. The first pin 13*a* and the second pin 14*a* are respectively disposed on the two lateral sides of the body 22*a* for enabling the primary coil and the secondary coil to be wound round the body 22*a* and electrically connected to an external circuit.

As shown in FIGS. 2E~2F, when the bobbin 20 is disposed in the fillister 23 with the lower surface of the body 22*a* facing the bottom 23*a* of the fillister 23, part of the fourth engaging blade 26 positioned on the lower surface of the body 22*a* is engaged with the first engaging blade 24*a*. Part of the edge of the fourth engaging blade 26 is abutted against the second engaging blade 24*b* and the third engaging blade 24*c*, so that the bobbin 22 is fixed in the fillister 23 in two mutually perpendicular directions such as the x direction and the y direction of FIG. 2F.

The present embodiment of the invention achieves the object of fast positioning the bobbin 22 and the base 21 for assembly by using the design of engaging the fourth engaging blade 26 of the bobbin 22 with the first engaging blade 24*a* of the base 21. Besides, the present embodiment of the invention uses the second engaging blade 24*b* and the third engaging blade 24*c* to separate the two iron cores disposed in the first magnetic core receiving region 25*a* and the second magnetic core receiving region 25*b* from the primary coil and the secondary coil wound in the bobbin 22, substantially enhancing the pressure resistance of transformer and complying with the current trend in the design of enlarging the scale of the liquid crystal display (LCD) panel and increasing the voltage of the lamp tube driving voltage.

Any one who is skilled in the technology of the invention will understand that the technology of the present embodiment of the invention is not limited thereto. For example, the first engaging blade 24*a*, the second engaging blade 24*b*, the third engaging blade 24*c*, the bottom 23*a*, walls 23*b* and 23*c* can be integrally formed in one piece. The body 22*a*, the fourth engaging blade 26, and the other blades on the body 22*a* can be integrally formed in one piece. Besides, the first engaging blade 24*a* and the fourth engaging blade 26 corresponding to the first engaging blade 24*a* can be two E-shaped structures. Furthermore, the bobbin module of transformer 20 further comprises a colloid used for filling up the fillister 23*a* and covering up the bobbin 22, the first iron core, the second iron core, the primary coil and the secondary coil. Thus, the tape cost as well as the complicated process and labor of enclosing the bobbin, the coil and the iron core are saved.

Third Embodiment

Figure 3A:
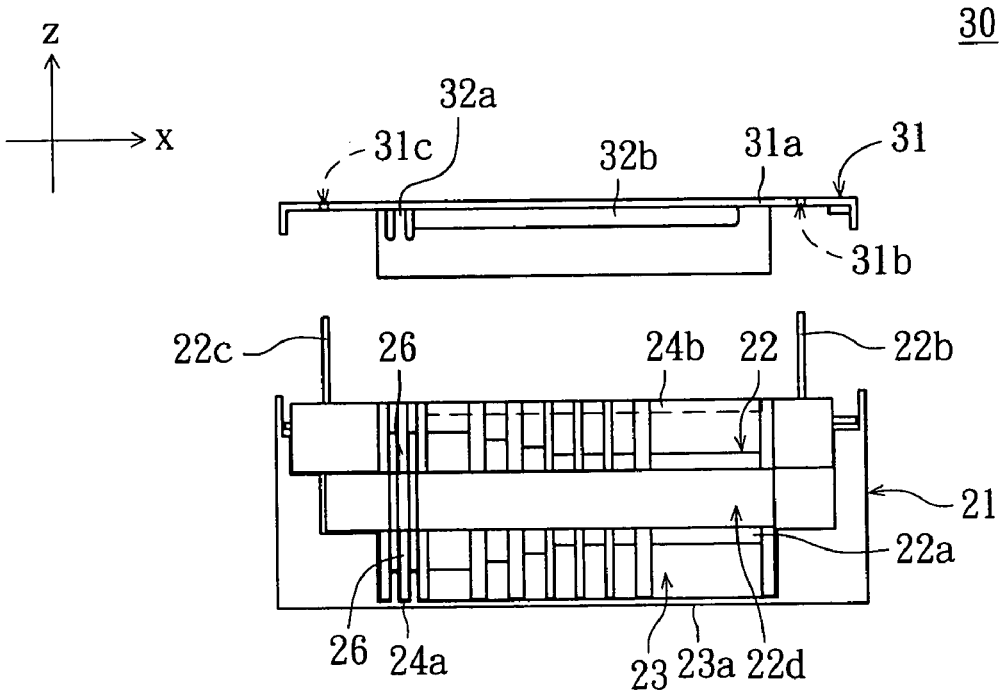
FIG. 3A is a part of cross-sectional exploded diagram of a bobbin module of transformer according toad third embodiment of the invention.
Figure 3B:
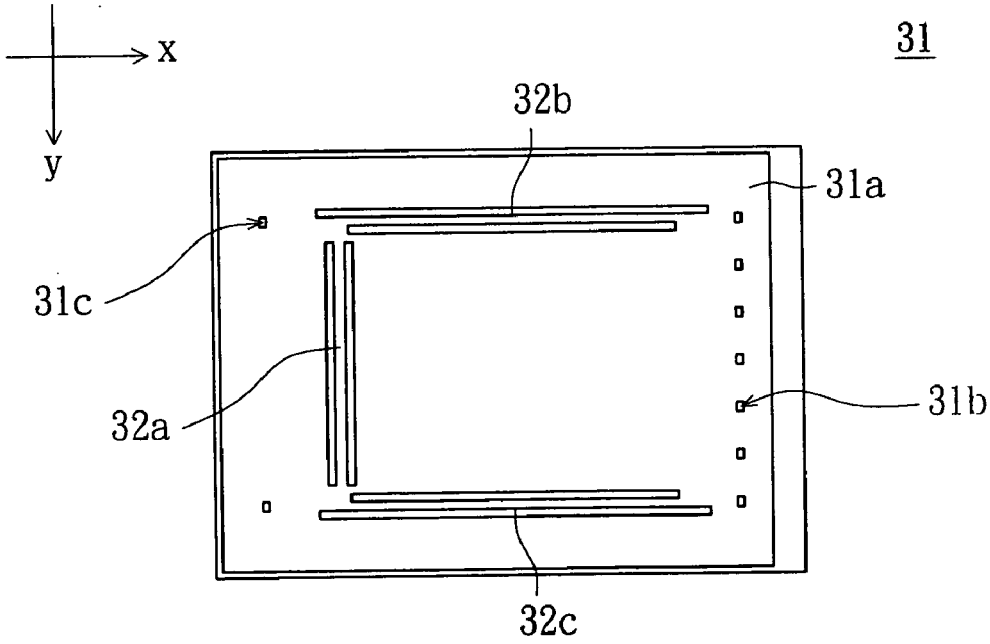
FIG. 3B is an upward view of a lift cover of FIG. 3A.
Figure 3C:
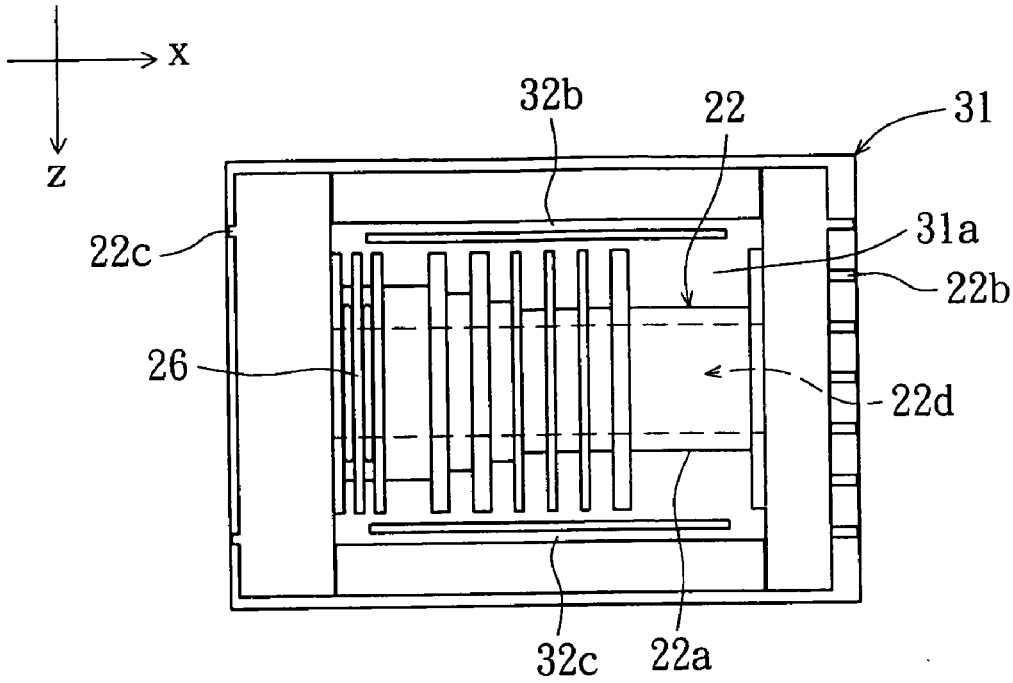
FIG. 3C illustrates the assembly of the lift cover of FIG. 3B and the bobbin of FIG. 2C.
Figure 3D:
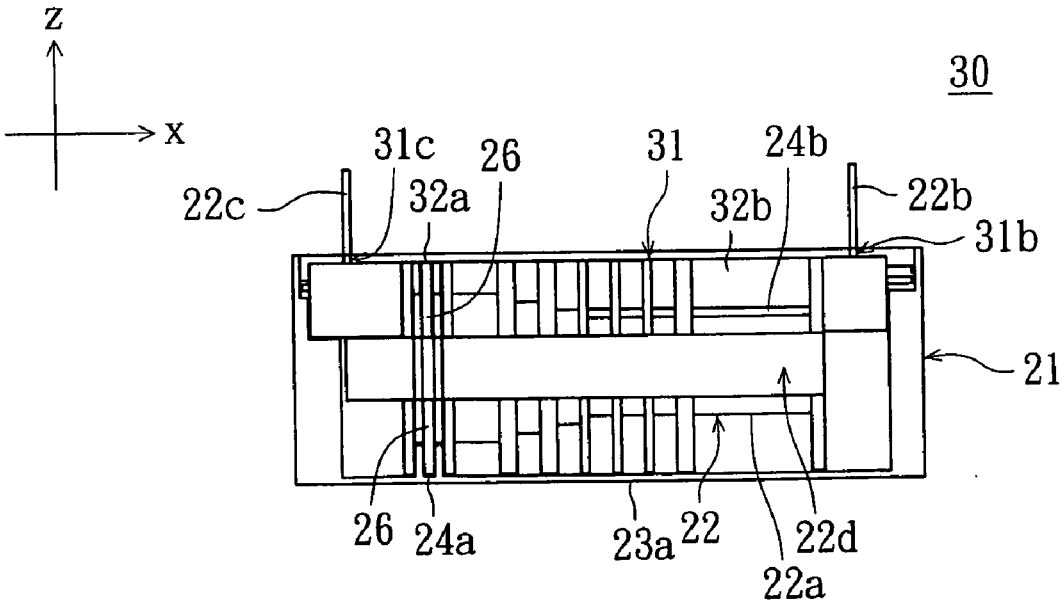
FIG. 3D is a cross-sectional assembly diagram of the bobbin module of transformer according to the third embodiment of the invention.

Please refer to FIGS. 3A~3D. FIG. 3A is a part of cross-sectional exploded diagram of a bobbin module of transformer according toad third embodiment of the invention. FIG. 3B is an upward view of a lift cover of FIG. 3A. FIG. 3C illustrates the assembly of the lift cover of FIG. 3B and the bobbin of FIG. 2C. FIG. 3D is a cross-sectional assembly diagram of the bobbin module of transformer according to the third embodiment of the invention. The bobbin module of transformer 30 of the present embodiment of the invention differs with the bobbin module of transformer 20 of the second embodiment in having a lift cover 31. As for other similar components, the same reference numbers are used and are not repeated here. In FIGS. 3A~3B, the lift cover 31 comprises a body 31*a*, a fifth engaging blade 32*a*, a sixth engaging blade 32*b* and a seventh engaging blade 32*c* parallel to the sixth engaging blade 32*b*. The body 31*a* has a number of openings 31*b* and 31*c*. The fifth engaging blade 32*a*, the sixth engaging blade 32*b* and the seventh engaging blade 32*c* are all disposed on the lower surface of the body 31*a*. The fifth engaging blade 32*a* is perpendicular to and positioned between the sixth engaging blade 32*b* and the seventh engaging blade 32*c*. The fifth engaging blade 32*a*, the sixth engaging blade 32*b* and the seventh engaging blade 32*c* are respectively engaged with the fourth engaging blade 26, the second engaging blade 24*b* and the third engaging blade 24*c* of FIG. 2F.

As shown in FIGS. 3C~3D, when the lift cover 31 is coupled with the base 21 at least having a bobbin 22, a first iron core, a second iron core, a primary coil and a secondary coil, the fifth engaging blade 32*a*, the sixth engaging blade 32*b* and the seventh engaging blade 32*c* of the lift cover 31 are respectively engaged with the fourth engaging blade 26 positioned on part of the surface of the body 22*a*, the second engaging blade 24*b* and the third engaging blade 24*c* disposed on the base 21 as shown in FIG. 2F, so that the lift cover 31 is coupled with the base 21 and covers the bobbin 22 from atop. Besides, the first pin 22*b* and the second pin 22*c* respectively pass through the openings 31*b* and 31*c* of the lift cover 31 to be exposed outside the lift cover 31 and electrically connected to an external circuit. Before the lift cover 31 is coupled with the base 21, if the colloid fills up the fillister 23*a* and covers the bobbin 22, the first iron core, the second iron core, primary coil and secondary coil, then the lift cover 31 will be coupled with the base 21 and cover up the bobbin 22 and the colloid. Thus, the design of covering up the bobbin 22 through coupling the base 21 with the lift cover 31 enhances the pressure resistance of the transformer. If the manufacturing process of filling the colloid is introduced, the pressure resistance of the transformer will be greatly enhanced.

Any one who is skilled in the technology of the present embodiment of the invention will understand that the technology of the invention is not limited thereto. For example, the body 31*a*, the fifth engaging blade 32*a*, the sixth engaging blade 32*b* and the seventh engaging blade 32*c* are integrally formed in one piece.

The bobbin module of transformer disclosed in above embodiments of the invention, has the following advantages:

1. The invention forms two bobbins of identical structure by having the hooker and the indentation of a bobbin which are symmetric to each other be coupled together, not only making the assembly faster, but also achieving the positioning in x, y and z directions for assembly lest the separation of bobbin might occur when the bobbin module receives an external force in the z direction. Besides, the invention only requires one set of mold. The manufacturer does not need to manufacture respective molds for the male bobbin and the female bobbin, largely decreasing the mold cost.

2. The invention achieves the object of fast positioning the bobbin and the base for assembly by using the design of engaging the fourth engaging blade of a bobbin with the first engaging blade of a base.

3. The invention uses the second engaging blade and the third engaging blade to separate the two iron cores disposed in the first magnetic core receiving region and the second magnetic core receiving region from the primary coil and the secondary coil wound in the bobbin, substantially enhancing the pressure resistance of transformer and complying with the current trend in the design of enlarging the scale of the LCD panel and increasing the voltage of the lamp tube driving voltage.

4. The invention uses the colloid to fill up the fillister and cover up the bobbin, the first iron core, the second iron core, primary coil and secondary coil, not only saving considerable tape cost, but also saving the complicated process and labor of using the tape to enclose the bobbin, the coil and the iron core.

5. The invention encloses the bobbin through coupling the base with the lift cover, substantially enhancing the pressure resistance of the transformer. If the manufacturing process of filling the colloid is introduced, the pressure resistance of the transformer will be greatly enhanced.

While the invention has been described by way of example and in terms of a preferred embodiment, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A bobbin module of transformer comprising two bobbins, wherein each bobbin comprising:

a body having a lateral surface; and a hooker and an indentation disposed on the lateral surface;

wherein the hooker and the indentation of the bobbin are respectively engaged with the indentation and the hooker of the other bobbin so that the two bobbins are combined together.

2. The bobbin module of transformer according to claim 1, wherein the two hookers are correspondingly inserted into part of the two indentations by forming a contained angle between the two lateral surfaces, and the two bobbins are at a preparatory assembly state;

wherein the two bobbins at the preparatory assembly state can be rotated to achieve a state that the two lateral surfaces are parallel to and face each other, so that the two hookers are correspondingly engaged with the two indentations.

3. The bobbin module of transformer according to claim 2, wherein the contained angle ranges between 35~45 degrees.

4. The bobbin module of transformer according to claim 2, wherein each of the two indentations has a gap and a recess accessible to each other, and each of the two hookers comprises:

an elbow whose one end is connected to the lateral surface; and a protrusion disposed on the other end of the elbow and protruded towards the lateral surface;

wherein when the contained angle is formed between the two lateral surfaces, part of the two elbows and the two protrusions are correspondingly inserted into the two gaps and part of the two recesses;

wherein when the two lateral surfaces are parallel to and face each other, the two protrusions are correspondingly coupled with the two gaps, and the two elbows are correspondingly inserted into the two gaps.

5. The bobbin module of transformer according to claim 1, wherein the two bobbins can be formed by using the same bobbin mold.

6. The bobbin module of transformer according to claim 1, wherein the body further has a through hole penetrating through a first surface and a second surface of the bobbin module.

7. The bobbin module of transformer according to claim 1, wherein each of the two bobbins further comprises:

a first pin disposed on a first surface of the bobbin module.

8. The bobbin module of transformer according to claim 7, wherein each of the two bobbins further comprises:

a second pin disposed on a second surface of the bobbin module.

* * * * *